US005941234A

United States Patent [19]

Norburn et al.

[11] Patent Number: 5,941,234

[45] Date of Patent: Aug. 24, 1999

[54] COMBUSTION CAGE FOR WOOD PELLET AND OTHER SOLID FUEL COMBUSTION

[75] Inventors: Robert B. Norburn, Dartmouth, Canada; Darryl R. Rose, Eastman, N.H.

[73] Assignee: Energex Inc., West Lebanon, N.H.

[21] Appl. No.: 08/777,469

[22] Filed: Dec. 30, 1996

[51] Int. Cl.[6] ..... F23M 5/00; F24B 1/08

[52] U.S. Cl. ..... 126/146; 126/77; 126/147; 126/152 B; 126/163 R; 126/283; 126/540; 110/108; 110/241

[58] Field of Search ..... 110/108, 197, 110/241, 248, 267, 235; 126/77, 144–146, 147, 152 B, 152 R, 163 R, 540, 245, 283

[56] References Cited

U.S. PATENT DOCUMENTS

| | | | |
|---|---|---|---|
| 4,298 | 12/1845 | Webb . | |
| 505,099 | 9/1893 | Gaylord | 110/240 |
| 727,287 | 5/1903 | Cartwright | 126/147 X |
| 741,192 | 10/1903 | Travis | 126/147 |
| 790,166 | 5/1905 | Wood-Allen . | |
| 984,200 | 2/1911 | Eastes . | |
| 1,092,112 | 3/1914 | Loeber | 126/240 |
| 1,176,233 | 3/1916 | Mead | 126/283 |
| 1,338,125 | 4/1920 | Dolen | 110/240 |
| 1,577,921 | 3/1926 | Mansfield | 126/145 |
| 1,629,162 | 5/1927 | Holman | 110/235 |
| 1,646,941 | 10/1927 | Tenenbaum | 126/245 |
| 2,119,827 | 6/1938 | Nelson | 126/146 |
| 2,702,012 | 2/1955 | Weggel | 110/193 |
| 2,768,022 | 10/1956 | Pope | 110/241 |
| 2,949,209 | 8/1960 | Schott . | |
| 3,266,478 | 8/1966 | Booth . | |
| 3,329,108 | 7/1967 | Hillman | 110/241 |
| 4,719,899 | 1/1988 | Burkhart | 126/163 R |
| 4,726,349 | 2/1988 | Gehrke | 126/152 R |
| 5,133,266 | 7/1992 | Cullen | 110/233 |
| 5,295,474 | 3/1994 | Whitfield et al. | 126/152 R |
| 5,347,935 | 9/1994 | Whitaker | 110/240 |
| 5,359,945 | 11/1994 | Buckner et al. | 126/146 X |

FOREIGN PATENT DOCUMENTS

| | | | |
|---|---|---|---|
| 1113280 | 8/1960 | Germany . | |
| 6-74436 | 3/1994 | Japan | 110/241 |
| 279989 | 11/1927 | United Kingdom | 126/540 |
| 2101737 | 1/1983 | United Kingdom . | |

OTHER PUBLICATIONS

WO 89/05424, "Burner for Wood Logs," Publication date: Jun. 15, 1989 International application published under the Patent Cooperation Treaty (PCT).

*Primary Examiner*—James C. Yeung
*Assistant Examiner*—Ljiljana V. Ciric
*Attorney, Agent, or Firm*—Robert R. Deleault, Esq.; Mesmer Law Offices, P.A.

[57] ABSTRACT

A combustion cage for pellet fuel is an inclined container having at least one wall surrounding a bottom and a support structure. The surrounding wall and bottom of the container have a plurality of holes throughout imparting a hole-to-surface ratio of at least 40% to the wall and bottom. The support structure supports the inclined container in a fixed, inclined position with reference to the horizontal.

23 Claims, 4 Drawing Sheets

COMBUSTION CAGE FOR WOOD PELLET AND OTHER SOLID FUEL COMBUSTION

BACKGROUND OF THE INVENTION

1. Field of the Invention

The present invention relates generally to combustion chambers. Particularly, this invention relates to wood pellet and other fuel combustion chambers that provide for complete and efficient combustion. More particularly, this invention relates to a combustion cage for burning wood pellet or other solid fuels, that can be inserted into a fireplace, wood stove, or other similar device. Even more particularly, this invention relates to a combustion cage for burning wood pellet or other solid fuels to burn these fuels more completely and efficiently, a device that does not require any additional mechanical or electrical devices to enhance or promote combustion.

2. Description of the Prior Art

Wood pellet fuel is an economical, organic and renewable fuel that is convenient, easy and safe to use. Wood pellet fuel produces a cleaner burn than traditional cordwood or other fuel such as coal and costs about the same to use for an equivalent overall heat output. When compared to the cost of electric heat in the Northeastern United States, wood pellet fuel usually costs about two-thirds less for a comparable amount of heat. With wood pellet fuel there is no chopping, hauling, splitting or stacking of logs, which all require a larger amount of storage space than that required for wood pellet fuel. Also, there is no bark dust or coal dust that seems to permeate and cover every exposed surface in the home.

Wood pellet fuel is environmentally friendly because it is typically made from sawdust, a manufacturing by-product which is normally dumped into landfills. The process begins by pulverizing clean waste sawdust to a uniform size and then drying it to a specific moisture content, usually between 5–8% by weight. Completely seasoned cordwood, on the other hand can have a moisture level of 20% or more.

The pulverized dust is then forced through a press under high pressure to produce a typical wood pellet. When these pellets are used as fuel, they produce a clean, reliable heat with very low particulate emissions and with extremely low ash content. Generally, they produce ten to twenty times less ash than the most efficient wood stoves currently marketed.

Wood pellet fuel is normally sold by the ton and is usually put into easy-to-handle 20–50 lb. bags. Wood pellet fuel is usually available for home delivery or can be purchased at any number of nurseries, feed and supply stores, hearth shops, wholesale food operators, and mass merchants. A ton of wood pellets will deliver approximately 16–18 million BTU's of heat, while a conventional wood stove delivers approximately 6–10 million BTU's per cord.

Storage of wood pellet fuel is also more convenient than storing cordwood. A cord of wood occupies 128 cubic feet, while a ton of pellets is about 48 cubic feet. Wood pellet prices range from $100/ton in towns where the wood pellets are produced to $200/ton elsewhere. Average retail cost in the West is $140/ton, slightly more in the East.

Many alternatives to wood pellet fuel have become commercially available for industrial use. These alternatives are commonly referred to as biomass fuels and include shells and husks from hazelnuts, walnuts, almonds, and pecans. Additionally, cotton by-products, grass stubble, US currency, other paper products, and even garbage have been used as biomass fuels. Home use of these alternatives is not far off. It is a combination of convenience, environmental concerns, preservation of Hardwood forests, and cleaner burn that makes burning wood pellet and similar biomass fuels so attractive.

It was found that conventional wood stoves could not make use of the advantages of wood pellet fuel. The reason is that the wood pellet fuel smoldered after igniting instead of burning efficiently. Consequently, wood pellet stoves were designed to take advantage of these new solid fuels. A traditional wood pellet stove includes a hopper, an auger, a firebox or grate, a combustion fan and a heat exchanger which, respectively, store, feed, burn the fuel and transfer the heat into the room. The auger operates in a timed manner for controlling the delivery of the pellet fuel from the hopper into the firebox. This delivery is timed such that the wood pellets are fed into the firebox at substantially the same rate at which they are burned. This controlled delivery is required so that the fuel burns efficiently. Too much wood pellet fuel in the firebox causes the wood pellets to smolder and burn inefficiently. This is due to the reduced air flow that occurs through the wood pellet mass as the size of the wood pellet mass increases. The air flow through the wood pellet mass is simply a function of the accumulation of the wood pellet mass which is directly related to the size and shape of the wood pellets, causing the restriction of air flow. This occurs even with supplying a driven air flow to the combustion chamber. Efficient burning in pellet stoves as well as wood stoves is important for keeping creosote buildup in the chimney to a minimum. Excessive creosote in the chimney increases the likelihood of chimney fires which can lead to disastrous consequences. Thus, it was discovered early on, that in order to burn pellet fuel efficiently, the wood pellets had to be delivered in a controlled fashion.

A combustion fan provides a measured amount of air, the driven air flow previously mentioned. This can be accomplished in one of two ways by either mixing with the fuel or to blow the waste gases out of the exhaust causing air to be sucked through the combustion chamber, thus ensuring proper combustion. A heat exchanger transfers this heat into the room.

There are now pellet stoves that do not need a combustion fan to work properly. However, these pellet stoves still require controlled delivery of the pellet fuel to the firebox so that the wood pellets are substantially burned at the same rate as they are delivered to prevent the smoldering mentioned above. In addition, the size, number, and placement of openings in the bottom and side walls of the firebox must be "tuned" to insure that a clean burn operation occurs. Furthermore, precise matching of chimney flue height and diameter with the augured feed rate is also needed for the pellet stove to operate efficiently.

Wood pellet stoves and similar devices are expensive to buy, generally in the range of $1,500 to $3,000 each. It is this initial expense that prevents many homeowners from substituting their wood stoves for wood-pellet stoves and enjoying the benefits of wood pellet fuel.

Currently, some of the prior-art devices use fireboxes or baskets to burn coal or cordwood. Other prior art devices teach wood stove attachments for burning charcoal. Firebox devices or grates for burning wood pellets have also been designed. However, these devices have been specifically designed for use in pellet stoves, not wood stoves.

To date, firebox devices for burning wood pellets or other solid biomass materials have been unavailable for use in wood stoves because it was not possible before now to effectively and efficiently burn wood pellets or similar biomass fuels in a device other than a specially-designed wood-pellet stove.

U.S. Pat. No. 5,295,474 (1994, Whitfield et al.) teaches a combustion grate with rods for a pellet-fueled stove. The grate assembly supports the pellets for combustion and directs combustion gas into the fire. It includes a passive grate of unequally spaced rods designed to prevent the ash and clinkers from accumulating on the grate in amounts that could reduce the flow of combustion air into the fire. This particular device was designed for use in pellet stoves that use combustion fans for forcing the air flow up through the bottom of the grate assembly and which use a controlled fuel delivery system.

U.S. Pat. No. 5,133,266 (1992, Cullen) teaches a pellet burning heating device designed to efficiently burn pellet fuel without the use of a combustion fan system for introducing combustion air into, or extracting exhaust gases from, the pellet stove. The pellet stove uses a specially-designed firebox for receiving the pellet fuel in a timed manner. The level of the pellet fuel in the firebox at any given time is critical to the proper functioning of the device. It requires that the chimney flue height and diameter be particularly matched to the timed delivery of the augured fuel for efficient burning to occur. This firebox is specially designed with "tuned" apertures for operation in a specially designed pellet stove.

U.S. Pat. No. 3,266,478 (1964, Booth) teaches a barbecue apparatus which is used for burning charcoal. This barbecue apparatus consists of a cabinet having an upper chamber and a lower chamber, a grill, an air blower, and a plurality of rectangular combustion baskets. The upper chamber is further divided into a plurality of compartments for accepting one of the rectangular combustion baskets. Each combustion basket has a grate bottom, perforated sides above a peripheral projecting flange which is in spaced relation above the grate bottom, handles, and an open top. The projecting flange of each basket seals off the upper chamber from the lower chamber so that air flow for combustion is permitted only through the grated bottom. This device is expensive to make and relies on a forced air flow to achieve an even burning of the charcoal held within each basket.

U.S. Pat. No. 4,289 (1845, Webb) teaches a portable stove that includes a casing, a grate in the shape of an inverted pyramidal form which is supported by brackets cast on the inside of the casing for providing heat on all sides of the portable stove, and hinged side doors that are supported when in a horizontal position and that allow direct access to the sides of the grate for cooking.

U.S. Pat. No. 790,166 (1905, Wood-Allen) teaches a charcoal-burning attachment for stoves consisting of a perforated sheet metal plate in the shape of a semi-circular trough. The semi-circular trough is designed to allow the fuel to fall towards the center of the trough as it burns, thus assuring that the fuel is all burned up. The design of the charcoal-burning attachment is specially made to fit any size of firebox of an ordinary cooking stove or range, not a heating wood stove. This device also was not designed for using wood pellet and other biomass solid fuels.

U.S. Pat. No. 984,200 (1911, Eastes) teaches a base burning heating stove for burning soft or hard coal and wood. This heating stove utilizes a cylindrically-tapered firebox which has perforated sides and two heavy iron crossbars at the bottom. Pivotally attached to the crossbars below the perforated sides is a shaking grate. The perforations in the sides are large openings through which a poker may be inserted for stirring the fire. The fire pot is specifically designed for use with the base-burning heating stove.

Therefore, what is needed is a combustion cage that is inexpensive to produce and easy to manufacture. What is also needed is a combustion cage that is easy to clean and repair. What is further needed is a combustion cage that can be made into any functional size for use in wood stoves, fireplaces and other combustion environments. What is still further needed is a combustion cage that is capable of providing complete, efficient and effective combustion of wood pellet or other solid biomass fuels without the aid of other mechanical devices such as combustion fans and timed fuel-delivering augers. Finally, what is needed is a combustion cage that is easy to use and that produces a consistent burn.

SUMMARY OF THE INVENTION

It is an object of the present invention to provide a combustion cage that is inexpensive to produce and easy to manufacture. It is another object of the present invention to provide a combustion cage that is easy to clean and repair. It is a further object of the present invention to provide a combustion cage that can be made into any functional size for use in wood stoves, fireplaces and other combustion environments. It is yet a further object of the present invention to provide a combustion cage that is capable of providing complete, efficient and effective combustion of wood pellet or other biomass fuels without the aid of other mechanical devices such as combustion fans and timed fuel-delivering augers. Still a further object of the present invention is to provide a combustion cage that is easy to use and that produces a consistent burn.

The present invention achieves these and other objectives by providing a combustion cage for use in conventional wood stoves. The design of the present invention permits a sufficient flow of combustion air to reach a substantial proportion of the surface area of the pellet or other solid biomass fuel that is being burned. This insures that the pellet fuel burns completely. In specially-designed pellet stoves, an auger delivers the pellet fuel in a timed fashion to the combustion firebox or grate. However, it was discovered during the early stages of pellet stove development that a combustion fan was required to enhance pellet burning and to prevent inefficient burning of the wood pellet fuel, i.e. smoldering, by increasing the air flow through the firebox. Smoldering and inefficient burning causes low heat output and excessive build up of creosote within the chimney, a dangerous situation that should be avoided. Creosote can ignite causing chimney fires from which disastrous consequences can result.

Unaided air flow through the firebox or grate is insufficient to prevent smoldering of the wood pellet fuel. This has a direct relationship to the size of the wood pellets. The wood pellets range in size from about ¼" to 5/16" in diameter and ¼" to 1" in length. Typically, the pellets resemble rabbit or cattle feed and are held together by lignins, the natural binder in the wood. Their small size gives rise to a tendency of a wood pellet mass to compact/crowd together causing a limited amount of air to flow between the individual pellets. This compacting tendency of the wood pellet fuel resulted in the incorporation of a controlled fuel-delivery system which is present in all pellet burning stoves. Controlled delivery of the wood pellets allows one to use a smaller amount of fuel which burns efficiently but quickly. After igniting the wood pellet fuel, the speed of the controlled delivery is matched to the burn rate of the fuel such that the wood pellets are burned at substantially the same rate at which they are fed to the firebox. Up until the present invention, this controlled fuel delivery system coupled with the use of small fuel burning volume was critical to the efficient burning of wood pellet fuel.

The present invention does not rely on other mechanical or electrical devices to provide enhanced combustion air flow to achieve complete combustion. Nor, does the present invention rely on electricity to power an auger for the timed delivery of the pellet fuel during the combustion process. The combustion of the wood pellet fuel or other similar biomass fuel is achieved in conventional wood stoves or fireplaces by configuring the combustion cage to burn most efficiently under the normal combustion process, i.e. the passive air flow, present in conventional wood stoves or fireplaces.

Unlike prior-art devices, the present invention allows ordinary wood stoves, fireplaces and similar combustion-heating devices to be used for burning wood pellet and similar biomass fuels. The unique design of the combustion cage allows a sufficient amount of combustion air to reach the fuel without mechanical aids. The present invention achieves more complete combustion of not only wood pellet and other solid biomass fuels in wood stoves than can be achieved using prior-art devices, but also more complete combustion of cordwood and coal. Furthermore, prior art devices are not as reliable as the present invention. If electricity is interrupted during use of the prior-art, wood pellet stoves and no backup electrical power is supplied, the auger stops delivery of the wood pellet fuel to the combustion chamber and the combustion fan ceases to force air through the remaining burning pellets. Loss of electrical power effectively means loss of the use of the wood-pellet stove. On the other hand, the present invention will continue to function properly regardless of the power loss.

The present invention uses a plurality of holes in the bottom and the side walls of the combustion cage. Other factors of combustion cage design were discovered which influence the efficiency of fuel burn and use in conventional wood stoves and fireplaces. These factors include the overall percent of perforations in the bottom and side walls, the size of the perforations in the bottom and side walls, the angle of inclination of the bottom of the combustion cage to the combustion chamber bottom of the wood stove, and the overall volume/capacity of pellet fuel mass.

The present inventors have determined that at least a 40% ratio of perforations to solid surface in the bottom and side walls of the combustion cage enhances the burning efficiency of the pellet fuel. As the ratio of perforations to solid surface drops below 40%, the pellet fuel begins to burn less efficiently. The amount of smoldering that occurs in the pellet fuel mass is inversely proportional to the hole-to-surface ratio when the ratio drops below 40%. Not only is the hole-to-surface ratio important, but the size of the openings influence the burn efficiency. Bearing in mind that the pellet fuel typically has a ¼" diameter and that hole diameter greater than ¼ inch makes it difficult to retain the pellet fuel within the combustion cage, air penetration of a pellet fuel mass has been calculated for a combustion cage having 1/16" openings with a 40% perforation-to-surface ratio and one having ¼" openings with a 40% perforation-to-surface ratio. Based on these experiments and calculations, a combustion cage with 1/16" openings has an air penetration into the fuel pellet mass of 0.5 inches. A combustion cage with ¼" openings has air penetration into the fuel pellet mass of 1.5 inches.

In addition to the above two factors, the angle of inclination of the combustion cage bottom to the bottom of the wood stove also influences the burn efficiency. This is due to the ease and extent of initial ignition of the pellet mass. It has been found that a combustion cage of the present invention having a positive angle of inclination with reference to the bottom of the wood stove's combustion chamber allows and promotes the natural progression of flames along the cage bottom, thus, decreasing the time required between initial ignition of the pellet fuel mass and its subsequent efficient burning. The more time required to change the burning status of the pellet fuel from the ignition stage to the efficient burning stage, the more smoldering that occurs which in turn creates more creosote. Even though the present invention still functions when the combustion cage bottom is in a horizontal position, the present inventors have found that the optimum angle of inclination to use is in the range of about 12 to about 30 degrees. If viewed from its side, the back of the present invention would appear higher than the front.

As previously mentioned, the volume of the wood pellet mass is another factor that affects the burn efficiency of the wood pellet fuel. Various volume configurations have been tested including a rectangular cube, a circular cylinder and an oval cylinder. In the rectangular configuration, pellet fuel volumes in the range of about 12" by 9" by 6", holding some 15 lbs of fuel, to about 15" by 12" by 10", holding some 42 lbs of fuel, and combinations in between have given desirable results. A circular cylindrical volume having a diameter of about 9" also burns the pellet fuel efficiently. For oval cylindrical volumes, a pellet fuel mass volume within the above ranges also will burn the pellet fuel efficiently.

The usefulness of the invention is related partly to the volume/capacity of the combustion cage, in that a fire needs to produce a comfortable amount of heat to be worthwhile. Many types of heating devices are capable of producing heat ranging from 10,000 BTU's to over 80,000 BTU's per hour, the usual sought after range would be within 20,000 to 40,000 BTU's per hour. Based on the knowledge that the pellets made from sawdust have a BTU rating of 8,500 BTU per lb., then a cage capable of holding between 12 lbs to 16 lbs is capable of producing 34,000 BTU's per hour for up to 4 hours.

It has been found that using combustion cages of the size and capacity mentioned, has produced a consumption rate of approximately 4 lbs of fuel per hour. This rate of combustion combined with the capacity of the cage makes use of the device attractive in that the device can produce useful amounts of heat for several hours before refueling is required.

It should be understood that rectangular and oval cylindrical volumes having horizontal length dimensions greater than about 12 to 15 inches have also been used successfully under certain conditions. This is accomplished in the present invention by separating and/or stacking the fuel in spaced compartments to allow sufficient combustion air to reach the fuel without relying on mechanical or electrical devices to enhance combustion air flow. These other embodiments of the present invention having larger fuel volume capacity require the use of double-walled inserts to divide those larger volumes into compartments that are comparably sized to the pellet fuel mass volumes stated earlier. In fact, compartmentalized volumes have been successfully used when formed by a double-walled insert having approximately a ¼" separation between the perforated walls of the insert. It is important to note that the amount of space between the perforated walls of the insert is not critical. The only limitation is that the insert be double-walled so that an air gap is formed which allows the free flow of combustion air there between.

Unlike the present invention, prior-art devices either have perforations that are too large to properly contain the wood pellet fuel or provide an insufficient air flow when unaided by mechanical means to efficiently burn the wood pellet fuel. Insufficient air flow in and around the wood pellet fuel causes the wood pellet fuel to smolder. Smoldering, in turn, produces lower heat output and incomplete burning of the fuel. The present invention overcomes these deficiencies by using properly-sized perforations throughout the combustion cage, both in the walls and the bottom of the container, to prevent fall-through of the wood pellet fuel and allow sufficient combustion air to enter the pellet fuel mass. These perforations, in combination with a sufficient hole-to-surface ratio and pellet volume mass, allows the present invention of reasonable scale, to efficiently burn a comparatively large fuel pellet volume, a volume capable of producing useful heat for up to 6–8 hours without replenishing the fuel.

The present invention can be manufactured in a variety of shapes and sizes to fit almost any wood stove or fireplace. These shapes may be rectangular or "cylindrical." The rectangular shapes encompass rectangular, cubic and trapezoidal volumes. The "cylindrical" shapes may be circular, ellipsoid or oval. Both types generally have supporting means such as legs, bars and the like for supporting the main housing portion of the present invention. The front supports are usually about 2 inches long while the back supports are generally either equal in length to the front supports or longer to provide an angle of inclination above the horizontal. As noted, better results have been obtained when the angle of inclination is in the range of about 12 to about 30 degrees from front to back. The supports may also be simply the continuation of the side walls where the bottom is recessed. Of course, in such a case, the side walls that extend below the bottom may have the perforations mentioned earlier or cut-outs to facilitate the natural air flow to the bottom of the combustion cage.

The present invention can be made out of perforated sheet metal, wire mesh, wire cloth, and the like. Choice of material will affect the usable life of the combustion cage of the present invention (Stainless Steel is presently used), but not its efficiency provided that the final product adheres to the factors/specifications mentioned earlier.

DETAILED DESCRIPTION OF THE PREFERRED EMBODIMENT

The preferred embodiment of the present invention and the novel method for burning wood pellet and other solid biomass fuels are illustrated in FIGS. 1–6.

Figure 1:
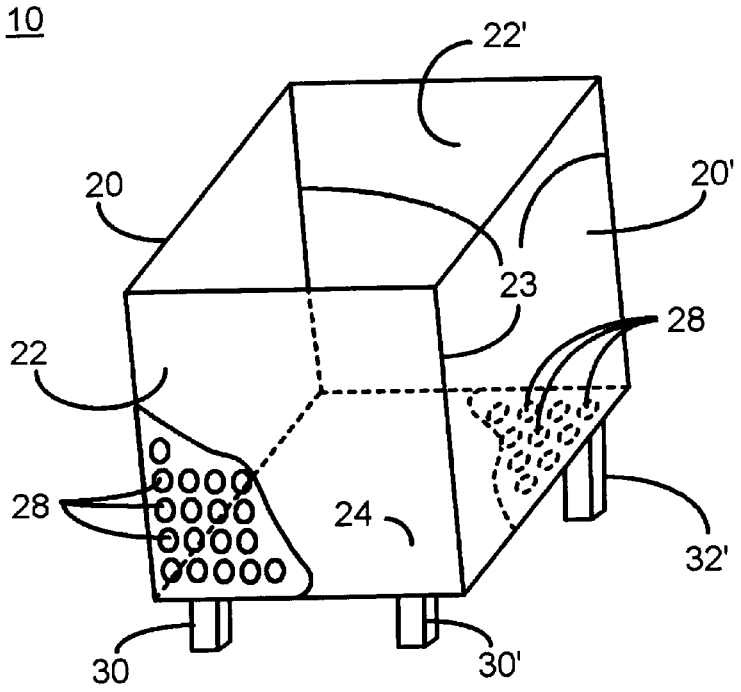
FIG. 1 is a perspective view of the rectangular-shaped embodiment of the present invention showing the combustion cage with perforated side walls.
Figure 7:
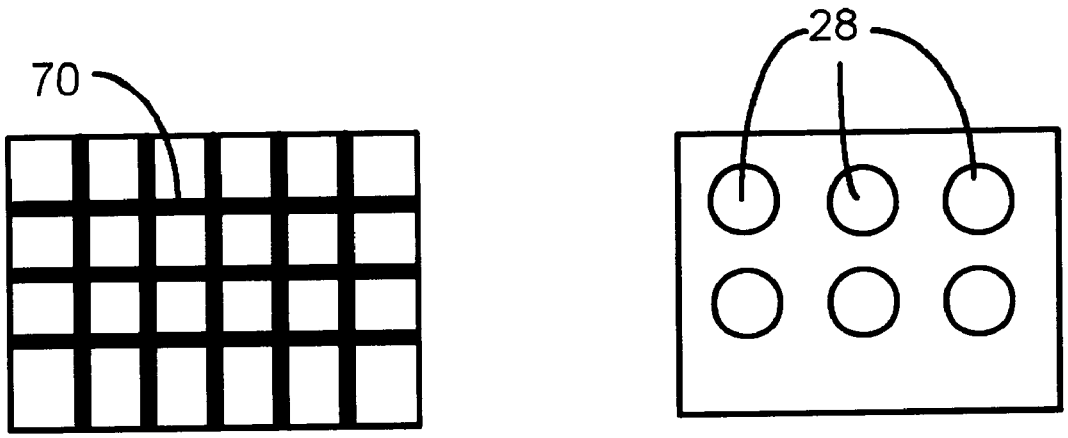
FIG. 7 is an enlarged view of the material used for making the container of the present invention showing typical shapes of the wire mesh, wire cloth and perforations.

FIG. 1 shows a rectangular-shaped combustion cage 10 for wood pellet or other solid biomass fuel having a front wall 20, a back wall 20', a first side wall 22 and a second side wall 22' connected end-to-end to each other at side wall seams 23 and to a bottom 24 forming a box. Front wall 20, back wall 20', side walls 22 and 22', and bottom 24 define a combustion space 26 for receiving wood pellet and other solid biomass fuel. Front and back walls 20 and 20', respectively, side walls 22 and 22', and bottom 24 each contain a plurality of holes 28 which allow combustion air to penetrate the fuel mass contained within combustion space 26. Even though a hole-to-solid surface ratio of less than 40% renders combustion cage 10 operational, a hole-to-solid surface ratio of at least 40% is preferred for efficient operation of the present invention. The plurality of holes 28 are preferably evenly spaced from each other. Perforated sheet metal, wire mesh, wire cloth, or other suitable material having the necessary hole-to-solid surface ratio may be used. FIG. 7 shows an enlarged view of the typical wire mesh/wire cloth 70 and perforations 28 of the preferred material. It is also understood by those skilled in the art that side wall seams 23 may be formed by bending an elongated piece of perforated sheet metal at appropriate locations.

Figure 2:
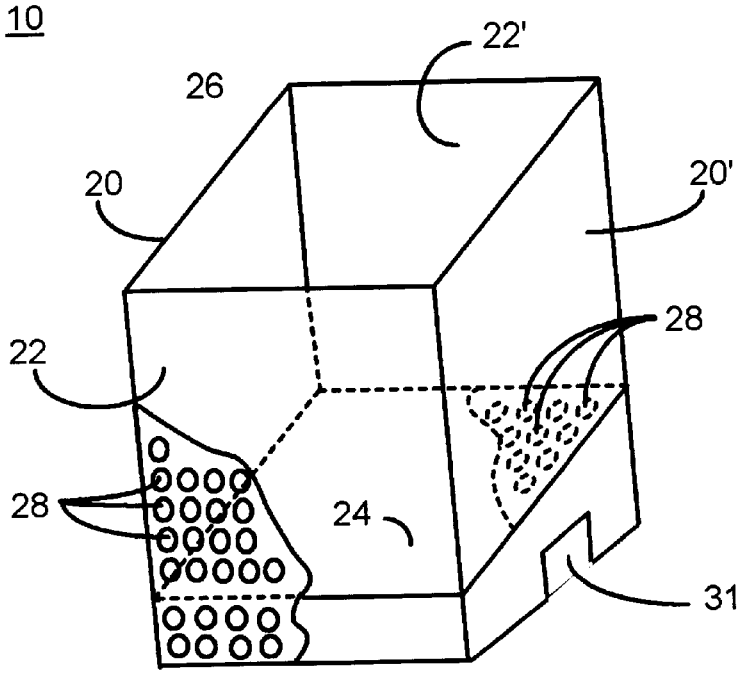
FIG. 2 is a perspective view of the rectangular-shaped embodiment of the present invention showing the combustion cage with extensions of the side walls functioning as the cage support members.

Front legs 30 and 30' are connected to the bottom 24 in a spaced-relationship from side wall 20, and rear legs 32 and 32' are connected to bottom 24 in a spaced relationship from side wall 20'. Front legs 30 and 30', and rear legs 32 and 32' support combustion cage 10 allowing free air flow to penetrate through the bottom 24. The preferred length of front legs 30 and 30' is approximately 2 inches. This height allows for a minimum amount of ignition material to be used when igniting a wood pellet fuel mass. In place of the legs 30, 30', 32 and 32' mentioned, any type of supporting structure such as single-piece supports may also be used. The supporting structure can also be extended segments of the front and rear walls 20 and 20' alone or in combination with extended segments of side walls 22 and 22' that extend below the bottom 24, as shown in FIG. 2. Where air flow is required to penetrate the bottom 24 of combustion cage 10, it is understood that the extended segments may also be perforated in a similar manner as front and rear walls 20 and 20' and side walls 22 and 22', or in the alternative, cut-outs may be made to the extensions.

Figure 3:
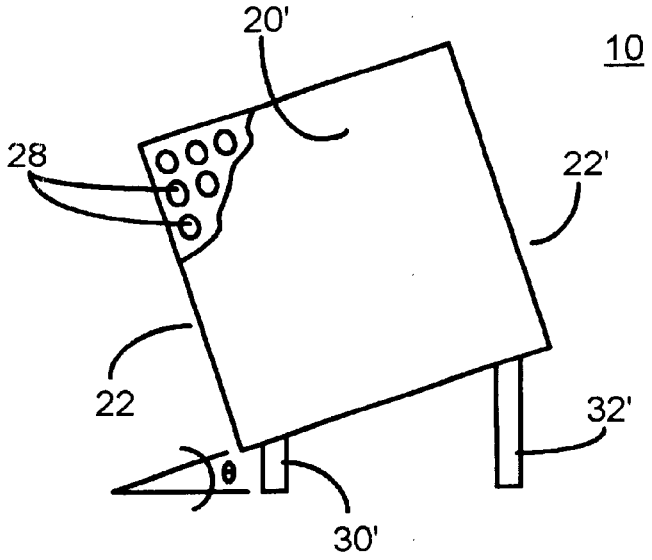
FIG. 3 is a side view of the rectangular-shaped embodiment of the present invention showing the combustion cage elevated to angle θ by two different size support members.
Figure 4:
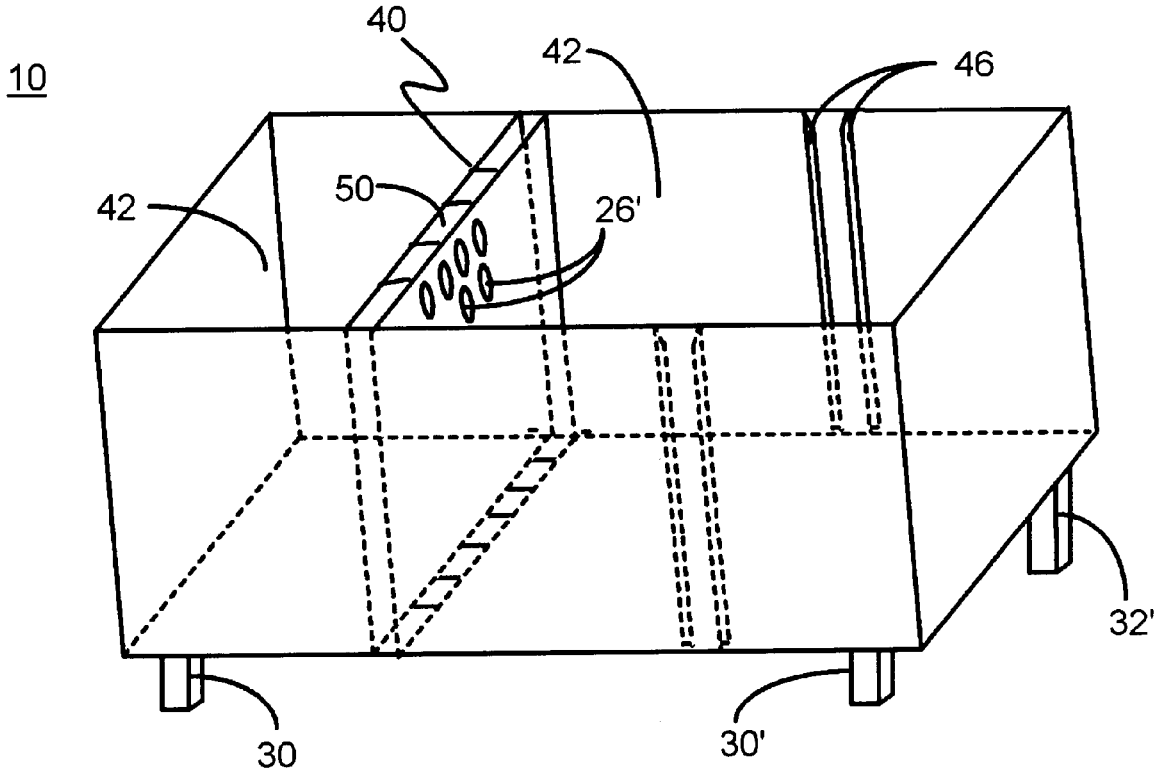
FIG. 4 is a perspective view of the rectangular-shaped embodiment of the present invention showing the combustion cage with perforated spacing elements used in a relatively long combustion cage.

Although rear legs 32 and 32' may also be approximately 2 inches long, it has been found that ignition is easier and the time required to attain the efficient burning stage after ignition is reduced when the rear legs 32 and 32' are such a length as to impart an angle of inclination θ in the range of 12 to 30 degrees from front wall 20 to back wall 20'. FIG. 3 is a side view of the present invention showing this angle of inclination θ. For example, a combustion cage 10 having front legs 30 and 30' equal in length to rear legs 32 and 32', requires an hour or more to change the status of the wood pellet fuel from the ignition stage to the burning stage. On the other hand, a combustion cage 10 having rear legs 32 and 32' longer than front legs 30 and 30', as illustrated in FIG. 4 and defining an angle of approximately 18 degrees, requires approximately 15 to 20 minutes to transform the same quantity of wood pellet fuel from the ignition stage to the burning stage. The actual length of rear legs 32 and 32' can be easily calculated by anyone skilled in the art. The angle of inclination θ also allows for easier loading of the combustion cage 10.

Figure 8:
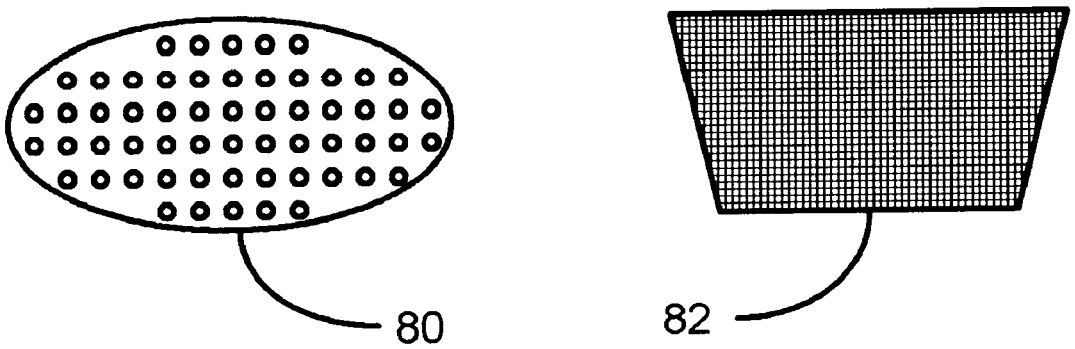
FIG. 8 is a top view of the present invention showing an ellipsoid-shaped container with a bottom having perforations, and an trapezoidal-shaped container with a bottom made with wire mesh.

Various sizes of combustion cage 10 have been tested. The chamber size that provides for a more efficient combination of burn time and burn efficiency has been found to be in the range of about 12" by 9" by 6" to about 15" by 12" by 10", and any combination in between. It should be noted that a trapezoidal shape or an elliptical shape may also be used, particularly when accommodating a specific wood stove design, provided that the overall wood-pellet volume capacity of combustion cage 10 remains approximately the same as defined above. FIG. 8 illustrates a top view of combustion space 26 and bottom 24 with perforations 28 having an elliptical shape 80. FIG. 8 also shows a top view of combustion space 26 and bottom 24 made from wire mesh 70 having a trapezoidal shape 82.

The size of the holes 28 affects the burn efficiency of combustion cage 10 because of the depth of air penetration into the solid fuel mass. While maintaining a hole-to-surface ratio of at least 40%, it has been calculated that ¼-inch holes provide for deeper combustion air penetration when combustion cage 10 is filled. The combustion air penetration is calculated to be approximately 1.5 inches into the solid fuel mass from any surface of combustion cage 10. For 1/16-inch holes with a similar hole-to-surface ratio, combustion air penetration is calculated to be approximately 0.5 inches into a comparable fuel mass.

Because wood stoves come in a variety of sizes, limiting the size of the present invention to the dimensions mentioned earlier may require the use of more than one combustion cage 10 in order to efficiently use the internal space provided within the fire chamber of the wood stove. A second embodiment of the present invention, shown in FIG. 4, alleviates the need for multiple combustion cages 10. A combustion cage 10 having a length greater than 15 inches, for instance a length in the range of 15 to 24 inches can also be used.

Referring now to FIG. 4, the same burn efficiency can be obtained by using a plurality of inserts 40 within combustion cage 10 creating a plurality of compartments 42. Each compartment 42 is approximately equal in volume to the efficient sizes referenced earlier for combustion cage 10 in FIG. 1. The inserts 40 are preferably double walled to create an air space or gap 50 at strategic points within the wood pellet fuel mass. The inserts 40 also have a plurality of holes 26' in the same hole-to-surface ratio mentioned earlier. This assures that a sufficient quantity of air flow, i.e. combustion air, is supplied to the burning pellet fuel mass to prevent smoldering.

Figure 5:
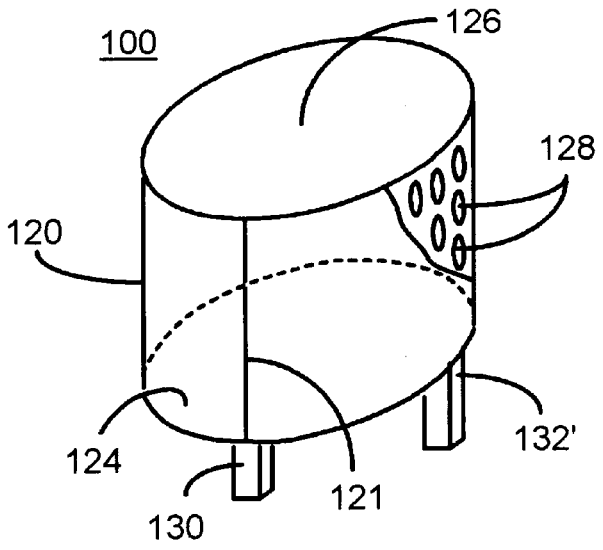
FIG. 5 is a perspective view of the circular-shaped embodiment of the present invention showing the combustion cage with supporting elements.

FIG. 5 shows a third embodiment of the present invention. FIG. 5 illustrates a circular-shaped combustion cage 100 having a cylindrical side wall 120, a cylindrical bottom 124, at least one front support member 130, and a back support member 132. The cylindrical side wall 120 and the bottom 124 each have a plurality of holes 128. The combustion cage 100 is best described as having the shape of a hat box. Due to its circular shape, the preferred diameter of combustion cage 100 is about 9 inches. This size has been found to burn the wood pellet fuel efficiently without smoldering. Combustion cage 100 has all of the preferred characteristics as those mentioned for combustion cage 10 in FIG. 1. This third embodiment of the present invention has the same required hole-to-surface ratio as mentioned previously.

Figure 6:
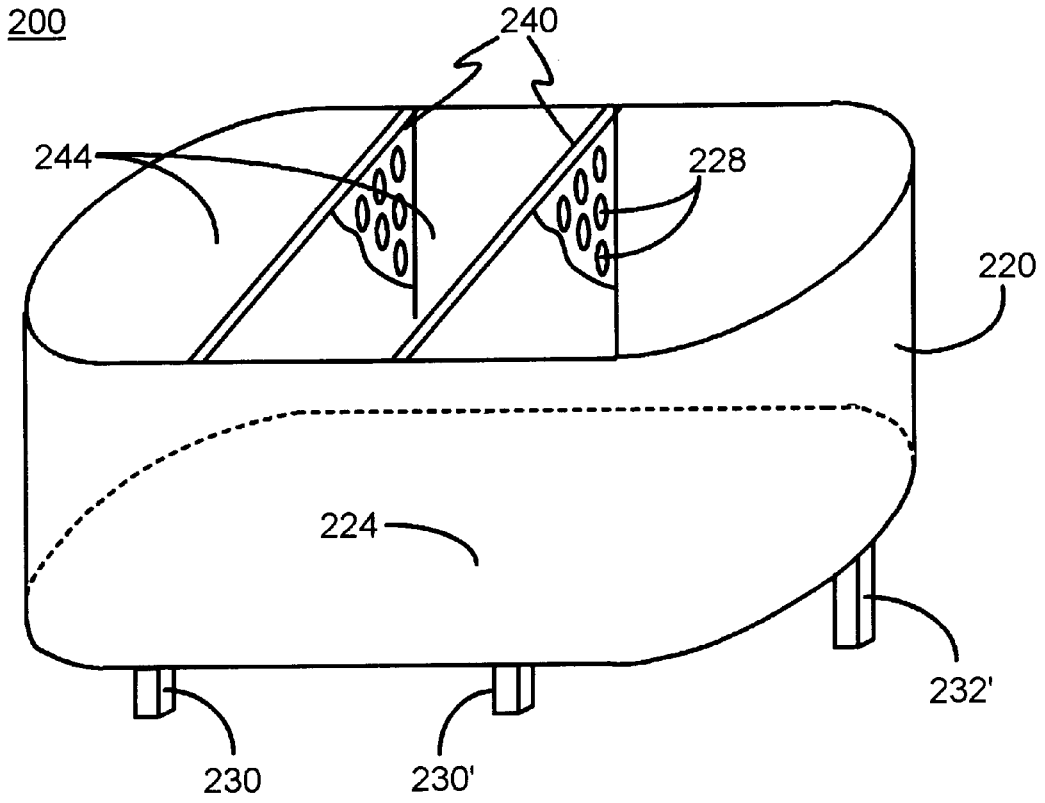
FIG. 6 is a perspective view of the oval-shaped embodiment of the present invention showing the combustion cage with perforated spacing elements.

A fourth embodiment of the present invention is illustrated in FIG. 6. FIG. 6 shows an oval-shaped combustion cage 200 having a continuous side wall 220, a similarly shaped bottom 224, front support members 230 and 230', rear support members 232 and 232', and double-walled inserts 240. In keeping with the spirit of the invention, combustion cage 200 has a plurality of holes 228 throughout such that the hole-to-surface ratio is at least 40%. Combustion cage 200 also has a preferred angle of inclination in the range of about 12 to about 30 degrees to optimize the transition from ignition to burning.

To make combustion cage 10, one simply pre-cuts the front and rear walls 20 and 20', the side walls 22 and 22', and the bottom 24. The side walls 22 and 22' are attached to the front and rear walls 20 and 20' forming a box. The connecting means may be accomplished by a weld line, various weld spots along the corners of the box, a hinge and pin design, an interlocking arrangement, or the like. However, due to the extremely high temperatures that combustion cage 10 endures and the constant expansion and contraction that occurs, a weld line or weld spots are more practical with regard to the useful life of combustion cage 10 before maintenance to the structure of combustion cage 10 is required. The bottom 24 is then attached to one end of the box structure. Front legs 30 and 30' and rear legs 32 and 32' are then attached to bottom 24. Where a combustion cage 10 is longer that the 12 to 15 inches recommended for efficient burning of the pellet fuel, double-walled inserts 40 are made and attached within the combustion cage 10 in a properly spaced relationship to create compartments 42 that are approximately equal in volume to the efficient sizes mentioned above. The wall inserts 40 may be permanently secured to combustion cage 10 or removably attached to combustion cage 10 having wall insertion guides 46 therein.

It is obvious to one skilled in the art that one could eliminate the precutting of the walls 20, 20', 22 and 22' by pre-cutting an elongated piece of properly-perforated metal followed by bending the elongated piece at the proper points along its length, thus forming seams 23 therein. Each end of the elongated piece would then be fastened together forming the box-like structure. To eliminate the need for separate support legs 30, 30', 32 and 32', bottom 24 may be recessed and angled within the walls 20, 20', 22 and 22' at the proper location to satisfy the previously-mentioned factors/specifications.

The circular and oval shaped combustion cages 100 and 200 are easier and less expensive to manufacture. Referring to FIG. 5, a single side wall 120 is securely attached to itself using any one of the number of securing means mentioned above such as a continuous weld line, line of weld spots, hinge and pin connector, hooks, and the like creating seam 121. Unlike combustion cage 10, there is only a single seam 121 in side wall 120, and no separate cutting or bending of the side walls is required. A matching bottom 124 is attached to side wall 120 creating a volume with one closed end. As in combustion cage 10, at least one front leg 130 and at least two back legs 132 and 132' are attached to bottom 124. In place of the legs 130,132 and 132' mentioned, any type of supporting structure such as single-piece supports may also be used. The supporting structure can also be an extension of side wall 120 and made as described earlier by attaching bottom 124 to side wall 120. The attachment is accomplished by recessing and angling bottom 124 within the side wall 120 at the proper location to satisfy the previously-mentioned factors/specifications. The circular and oval shaped combustion cages 100 and 200 may also be made with larger than the efficiency-limiting volumes discussed earlier, provided that smaller compartments are configured using double-walled inserts. Referring to FIG. 6, double-walled inserts 240 for oval-shaped combustion cage 200 are used to create compartments 244 that are each no larger than the efficiency-limiting volume prescribed above.

The present invention is simple and easy to use. To illustrate, one simply inserts one of the embodiments, for instance combustion cage 10, of the present invention into a wood stove or a fireplace. The combustion cage 10 is filled with wood pellet or other solid biomass fuel. Kindling or fire starter material is placed in the space beneath bottom 24 and ignited. Adjustments to the wood stove's damper and air intake vents, or those of a fireplace, are then adjusted as normally done when burning cordwood. The present invention also burns ordinary cordwood and coal and other solid fuels efficiently.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A combustion cage for burning wood pellet and other solid fuels, said combustion cage comprising:

an inclined container having at least one wall completely surrounding a bottom and forming at least one compartment of predetermined volume for holding a mass of wood pellet and other solid fuel;

a plurality of holes throughout said at least one wall and said bottom wherein said at least one wall and said bottom have least a 40% hole-to-surface ratio; and a support structure operatively connected to said bottom and supporting said container in a fixed, inclined position with reference to the horizontal whereby combustion air enters through said plurality of holes of said bottom.

2. The combustion cage as claimed in claim 1 wherein the size of each of said holes in said container are substantially equal in size.

3. The combustion cage as claimed in claim 1 wherein the size of each of said holes is about 1/16 inch to about 1/4 inch diameter.

4. The combustion cage as claimed in claim 1 wherein said container has an angle of inclination in a range of about 12 degrees to about 30 degrees with reference to the horizontal.

5. The container as claimed in claim 1 wherein said combustion cage further includes at least one divider.

6. The combustion cage as claimed in claim 5 wherein said at least one divider is removable.

7. The combustion cage as claimed in claim 5 wherein said at least one divider further includes a first divider wall and a second divider wall adjacent to each other.

8. The combustion cage as claimed in claim 7 wherein said first divider wall and said second divider wall are in spaced relationship to each other forming a gap.

9. The combustion cage as claimed in claim 7 wherein each of said first divider wall and said second divider wall has a plurality of holes.

10. The combustion cage as claimed in claim 9 wherein the size of each of said holes in each of said first divider wall and said second divider wall is about 1/16 inch to about 1/4 inch diameter.

11. The combustion cage as claimed in claim 9 wherein said plurality of holes in each of said first divider wall and said second divider wall has at least a 40% hole-to-surface ratio.

12. The combustion cage as claimed in claim 1 wherein said support structure has a height of at least one inch at the lowest point of said inclined container.

13. The combustion cage as claimed in claim 1 wherein said support structure are legs.

14. The combustion cage as claimed in claim 1 wherein said support structure are extensions of said at least one wall surrounding said bottom and extending below said bottom.

15. The combustion cage as claimed in claim 14 wherein said extensions have cut-outs.

16. The combustion cage as claimed in claim 1 wherein the shape of said container is selected from the group consisting of rectangular, circular, ellipsoid, oval, and trapezoidal.

17. The combustion cage as claimed in claim 1 wherein said container is made of at least one of perforated metal, wire mesh and wire cloth.

18. The combustion cage as claimed in claim 1 wherein said at least one compartment has a volume sized to allow sufficient combustion air into said wood pellet fuel mass, to prevent said wood pellet fuel mass from smoldering, and to provide useful amounts of combustion heat without refueling for at least one hour.

19. A combustion cage for burning wood pellet or other solid biomass fuels, said combustion cage comprising:

an inclined receptacle for holding a mass of wood pellet and other solid fuel, said receptacle having at least one wall completely surrounding a bottom wherein said at least one wall and said bottom form at least one compartment of a predetermined volume and have a plurality of apertures in sufficient quantity and evenly distributed throughout each of said at least one wall and said bottom to have at least a 40% hole-to-solid surface ratio; and a supporting means operatively attached to said receptacle and supporting said receptacle in a fixed, inclined position with reference to the horizontal and wherein said support means imparts an angle of inclination to said receptacle in the range of about 12 degrees to about 30 degrees.

20. The combustion cage as claimed in claim 19 wherein said receptacle further includes a divider forming at least two compartments in said receptacle, said divider having a first divider wall operatively attached in spaced relationship to a second divider wall forming a gap between said first divider wall and said second divider wall, said first divider wall and said second divider wall each having a plurality of openings in sufficient quantity to impart a hole-to-solid surface ratio of at least 40%.

21. The combustion cage as claimed in claim 20 wherein said apertures are in the range of about 1/16 inch to about 1/4 inch diameter.

22. The combustion cage as claimed in claim 20 wherein each of said at least two compartments has a volume size to allow sufficient combustion air into said wood pellet fuel mass, to prevent said wood pellet fuel mass from smoldering, and to provide useful amounts of combustion heat without refueling for at least one hour.

23. The combustion cage as claimed in claim 19 wherein said receptacle is made of at least one of perforated metal, wire mesh and wire cloth.

* * * * *